United States Patent [19]

Seeley et al.

[11] Patent Number: 4,470,348

[45] Date of Patent: Sep. 11, 1984

[54] PRINTER-PROCESSOR SYSTEM

[75] Inventors: Dunham B. Seeley, Fairport; William I. Blazey, Walworth, both of N.Y.

[73] Assignee: Burroughs Corporation, Detroit, Mich.

[21] Appl. No.: 381,677

[22] Filed: May 25, 1982

[51] Int. Cl.[3] ..... B41F 5/24

[52] U.S. Cl. ..... 101/219; 101/DIG. 11; 101/167; 270/52; 400/613.2

[58] Field of Search ..... 101/212, 216, 219, DIG. 11; 270/52; 400/611, 613.2, 658

[56] References Cited

U.S. PATENT DOCUMENTS

| | | | |
|---|---|---|---|
| 988,560 | 4/1911 | Evensen | 101/DIG. 11 |
| 2,488,871 | 11/1949 | Locke | 101/DIG. 11 |
| 3,389,656 | 6/1968 | Giori | 101/167 |
| 3,640,220 | 2/1972 | Fulk | 101/219 |
| 3,888,340 | 6/1975 | Hoffman | 400/611 |
| 3,955,750 | 5/1976 | Huffman | 400/613.2 |
| 4,042,401 | 8/1977 | Newman et al. | 101/129 |
| 4,152,986 | 5/1979 | Dadowski | 101/216 |
| 4,235,430 | 11/1980 | Fulk | 270/52 |
| 4,328,749 | 5/1982 | Inouye et al. | 400/613.2 |
| 4,347,009 | 8/1982 | Brown | 400/568 |

*Primary Examiner*—William Pieprz

*Attorney, Agent, or Firm*—David G. Rasmussen; Kevin R. Peterson; Edmund M. Chung

[57] ABSTRACT

A printer-processor is used to print multi-ply business forms. The printer processor uses paper from a paper roll and uses an absorptive ink which dries substantially by absorption. The ink stays in liquid form during stopping and starting periods of the printer processor. The ink is also thixotropic so as to remain at proper film thickness on the printing surfaces of the printer processor at operational speeds or when stopped. The absorptive thixotropic ink enables the printer processor to deliver to the collator webs of paper having an uninterrupted sequence of images of uniform quality. The paper has one continuous path between the printer processor and the manifold forms collator. To enable the printer processor to print all common form sizes from small cylinders, a unique cluster of gears arrangement is attached to the impression cylinder of the printing unit. This cluster contains gears with circular pitches which are the increments which are evenly divisible into the common form sizes.

15 Claims, 5 Drawing Figures

| PLATE CIRCUMFERENCE (INCHES) | DOCUMENT SIZE (INCHES) | CIRCULAR PITCH (INCHES/TOOTH) | DIAMETER (INCHES) |
|---|---|---|---|
| 6.00 | 6 | 1/5, 1/6, 1/8 | 1.910 |
| 6.80 | 3 2/5 | 1/5 | 2.165 |
| 7.00 | 7, 3 1/2 | 1/5, 1/6, 1/8 | 2.228 |
| 7.33 | 7 1/3 | 1/6 | 2.334 |
| 8.00 | 8, 4 | 1/5, 1/6, 1/8 | 2.546 |
| 8.40 | 2 4/5 | 1/5 | 2.674 |
| 8.50 | 8 1/2, 4 1/4, 2 5/6 | 1/6, 1/8 | 2.706 |
| 9.33 | 4 1/3 | 1/6 | 2.971 |
| 9.60 | 4 4/5 | 1/5 | 3.056 |
| 11.00 | 11, 5 1/2 | 1/5, 1/6, 1/8 | 3.501 |
| 11.33 | 5 1/3 | 1/6 | 3.608 |

PRINTER-PROCESSOR SYSTEM

BACKGROUND OF THE INVENTION

1. Field of the Invention

The invention involves a printer-processor for preparing individual plies from a paper roll for collating in a manifold business forms collator to make multi-ply business forms.

2. Description of the Prior Art

A manifold business form is made up of a number of plies, each of which is printed with specific information and may have boxes for information, or alphanumeric character entry. Examples of such business forms are multi-layer invoices or bills sent out to consumers which are snap-apart forms. Presently the manufacture of such forms requires a large amount of machinery. One two-part system for making such forms, described subsequently in FIG. 1 uses one or more press units and a collator. The press unit(s) prepares the individual plies on a paper web. The collator receives the web, separates the plies and puts them together in the form. The press is roll-fed and made up of one or more printing units, optional units for punching and perforating as may be required on the particular form, and a unit to punch one or more lines of marginally located holes which are registered in a known relationship to the printing and other operations. Such presses may deliver the webs into zigzag folded packs or more usually wind them back into rolls.

Plies are processed through presses, usually the same press, a ply at a time or on occasion side by side, if the paper and ink colors are common.

Most presses are quite large and are constructed in a way so that the cylinder circumferences are not changeable or if changeable require large and expensive modules to be changed. This situation has led to the evolution of a number of standard form sizes which are evenly divisible into a relatively small number of press circumferences. Additionally, devices which write on manifold forms most commonly vertical space in increments of 1/6", ⅛" and less often 1/10".

This combination of circumstances has led to commonly used press circumferences and form sizes evenly divisible into them as follows:

| Press Circumferences | Form Sizes |
|---|---|
| 17" | 2 5/6", 3 4/10", 4¼", 5⅔", 8½" |
| 14" or 21" | 3½", 7" |
| 22" | 2¾", 5½", 7⅓" |
| 24" | 3", 4", 5½", 6" |
| 26" | 3¼" |
| 19" | 4¾" |

There are other circumferences and form sizes in use, but very few. The first three lines show the most common press circumferences and form sizes.

Thus, each individual press typically must be purchased for and dedicated to the manufacture of a limited number of the total assortment of commonly purchased form sizes.

The collator assembles the plies by pin feeding the individual plies from the rolls or packs simultaneously, using the marginally punched holes for feeding and piloting to superimpose the plies into proper register. The collator may also interweave carbon tissues or fasten plies and carbon tissues together. Collators are equipped with appropriate devices to either deliver snap-apart sets or continuous manifold forms. They may have the means for holding and unwinding rolls or unfolding zigzag folded packs to suit the style or press which performed the preceding operation. Collators are typically troublesome machines with much need to stop, adjust and restart. Also collators are multi-circumference machines and can be readily changed to produce any common size form.

Conventional flexographic presses have been used to print business forms. These presses are variable repeat in increments of the circular pitch or gearing used on the particular press. However, these normally require ink dryers and have not been widely popular.

Most of the two types of presses described above print via offset lithography. A small but significant minority print via letterpress or dry offset. All three kinds of print units use paste inks which dry, at least in part, by oxidation or polymerization and which must be distributed to the plates via fairly complex inkers having many rollers which require attention, adjustment, and cleaning by skilled operators. These types of printing waste a substantial amount of paper during setup and produce one or many defective images on start up after each time a printing unit is stopped for any reason.

Another common method of printing is a single step and involves multi-web presses which print and perform the other operations needed on the finished form on all webs simultaneously and deliver the product, finished, as the collator would deliver it. Setup time, and plate cost, since a complete set is needed per web, and start up waste is much higher on multi-web presses than on single web presses, therefore, while they are efficient in a running mode, they are only cost effective for very large orders.

To overcome the problems of the prior art, it would be advantageous to have a printer processor which would:

(a) Take advantage of the circumference flexibility of collators by allowing them to receive directly from the printer processor a variety of webs having different size plies, thus reducing investment required to produce all common size forms.

(b) Utilizing novel type of printing to allow the printer-processor to be stopped and started in conjunction with the collator thus eliminating the normal high setting up cost and paper waste due to stops and starts.

(c) Deskilling the printing operation and making the changeover from one printed copy to another essentially an adjustment free procedure.

(d) Doing all of the above with printing units having a plate cylinder driving system which allows common form sizes to be printed with cylinders of much smaller than normal circumferences which are easily manhandleable without hoists or other mechanical assists and which require plates of fewer images, thus costing less.

The basic idea is to eliminate the need to process plies through a cumbersome press but instead process the plies through a printer-processor which does the above, is small, is easily mounted next to a collator, and can feed a paper web of plies directly to the collator. This basic idea is made economically and operationally feasible by two novel features.

SUMMARY OF THE INVENTION

The two novel features are:

1. A combination of a thixotropic-absorptive ink printed via a flexographic printer which produces an unbroken sequence of uniformly acceptable images regardless of stops and restarts; does that as soon as a plate cylinder is put into position and the unit started; and does those things at all operating speeds, consistently, without need for any skillful adjustment.

2. A cluster of gears arrangement which uses small circumference plate cylinders which are light, quick to install and remove, inexpensive themselves, and require only small, therefore, inexpensive plates.

These two novel features are embodied in the applicant's printer-processor. The apparatus includes a printer-processor using paper from a paper roll. The printer-processor uses an absorptive ink which dries substantially by absorption. The ink stays in liquid form during stopping and starting periods of the printer-processor. The ink is also thixotropic so as to remain at proper film thickness on the printing surfaces of the printer-processor at operational speeds or when stopped. The absorptive thixotropic ink enables the printer-processor to deliver to the collator webs of paper having an uninterrupted sequence of images of uniform quality. The paper has one continuous path between the printer-processor and the manifold forms collator.

To enable the printer-processor to print all common form sizes from small cylinders, a unique cluster of gears arrangement is attached to the impression cylinder of the printing unit. This cluster contains gears with circular pitches which are the increments which are evenly divisible into the common form sizes.

The plate cylinders have single gears attached which are axially located so that when plate cylinders are put into the flexographic printer, plate cylinders having a specific circular pitch gear engage the same circular pitch gear of the cluster on the impression cylinder, and so forth.

Thus, as an example, a plate cylinder for printing a 3 4/10" form need have a circumference of only 6 8/10" or 3 4/10" and bear only two or one image around its circumference. This compares with the conventional 17" circumference cylinder used to print this size form. A 17" circumference cylinder may be too large to lift into the printer without an assisting device. It requires a larger and more costly plate bearing five images. Experience has shown that cylinder circumference as small as 3" are usable.

DETAILED DESCRIPTION OF THE PREFERRED EMBODIMENT

Figure 1:
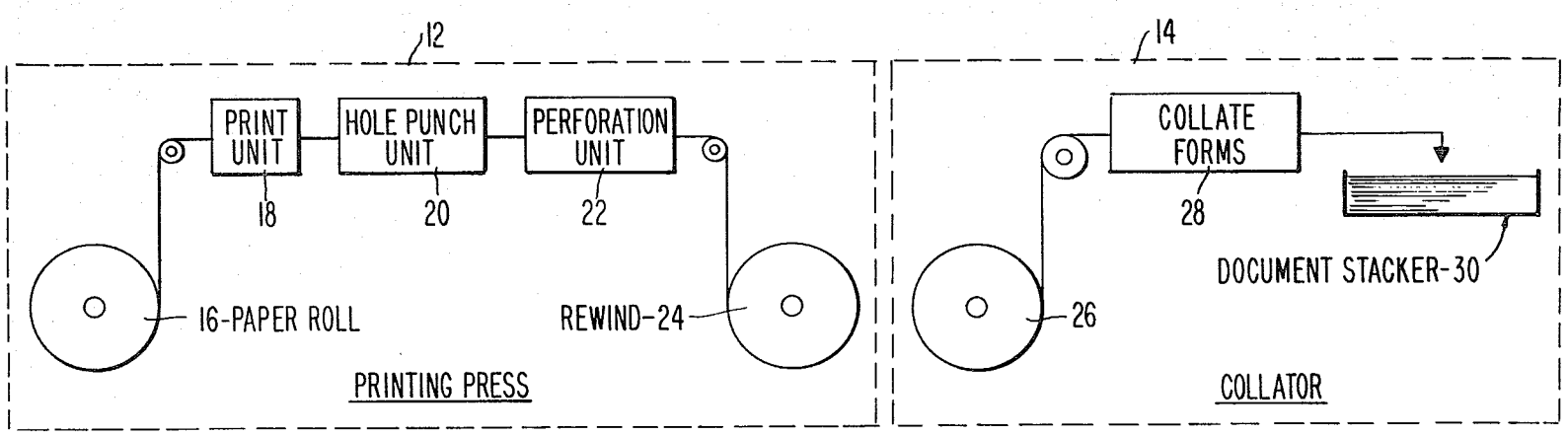
PRIOR ART Fig. 1
FIG. 1 is a block diagram of a prior art printing and collating system for the manufacture of manifold business forms.

FIG. 1 shows a prior art system for printing manifold business forms. The system includes a printing press 12 and a manifold forms collator 14. The printing press 12 includes a paper roll 16, a print unit 18, a hole punch unit 20, a perforation unit 22, and an unwind 24. The prior art collator unit includes paper roll 26, the collating mechanism 28, and the document stacker 30. In a typical operation, a roll of paper 16 is fed through a print unit 18 which repeat prints a form at periodic intervals on paper roll 16. Next the page is fed through hole punch unit 20 which puts holes along the side of the paper. These holes allow the paper to be kept in registration in the collator unit. In addition, they serve as a means of advancing the paper. The paper is then fed to perforation unit 22 which perforates the paper such that the individual plies are formed on the paper roll. The paper roll is then fed from the perforation unit onto unwind 24.

In a manifold business form there will normally be multiple plies. Typically the same press processes all of the plies in a manifold form order in sequence, thus utilizing some of the plates and setup on more than one ply. Each ply is wound on a separate roll. The rewound paper rolls are then fed to the collator which performs the process of separating each of the plies at the perforations and placing each of the different plies in layers, such that the manifold business forms may be made in forms collator 28. The manifold form is then deposited in document stacker 30, or zigzag folded into a continuous form.

Also in the prior art, there are multi-web machines called unit presses which perform all required operations on all webs simultaneously, and also assemble the plies, thus combining press and collator operations into one. These are very productive when running, however require large set up waste and time, and therefore, are usable only for very large orders.

Figure 2:
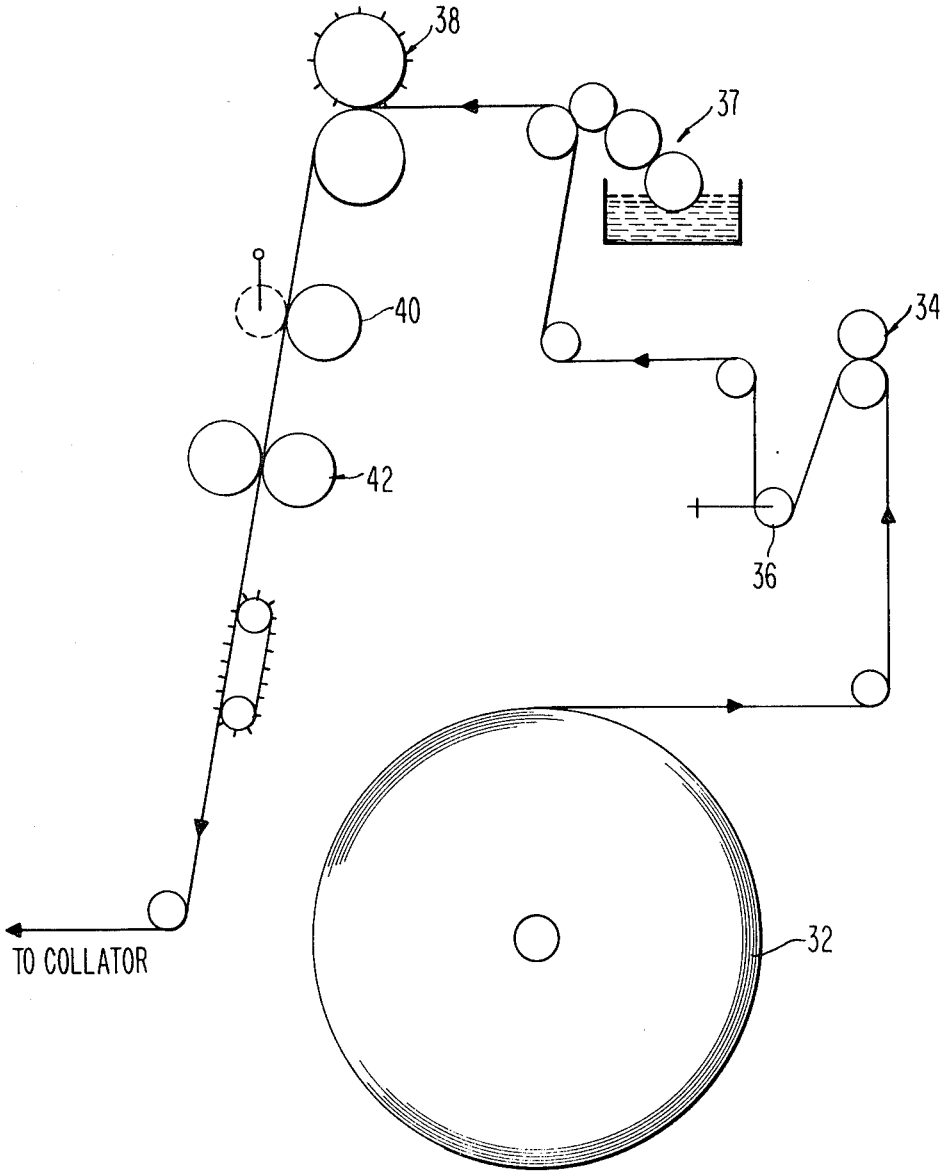
FIG. 2 is a diagrammatic view of the printer-processor of the present invention for preparing individual plies to be fed directly into a collator unit.

FIG. 2 shows a schematic diagram of the novel printer-processor for preparing individual plies for use in a standard prior art collator. The printer-processor basically replaces printing press 12 of the prior art type printing and collating system. A blank paper roll 32, the same as paper roll 16 of FIG. 1, feeds paper to a variable speed infeed 34 which controls the speed at which paper is fed into the printer-processor. The paper is then fed to infeed control dancer 36 which prevents slack in the paper path. The paper is then fed to a "flexographic" printer 37. The flexographic printer is known in the art. This printer has changes made to it which are the heart of the invention. These changes are described more fully in FIG. 3. The change in the printer involves a new type of ink for the flexographic printer which allows the printer-processor unit to be stopped and started for long periods, such as half an hour, without the ink drying on the rollers of the printer. In addition, the ink will remain at the proper film thickness on the printing surfaces at operational speeds or when stopped. This allows the printer-processor to be stopped during the frequent stops that are necessary for the collator unit. Since the printer may be stopped, the printed forms from the printer-processor may be fed directly to the collator as the collator needs them. The ink formulation is not novel but its use in the printer-processor enables the present invention to be operational.

As stated previously, the problem with printers was that if the printer stopped for even a short time the ink dried on the roller and a portion of a ply did not print. With several printers stopping and starting, these partially printed plies could show up any place along the rewound paper rolls. As these rolls were fed into the collator unit, where the plies were separated, the partially printed plies could show up on any form or in any ply of a form. This created an impossible problem of attempting to inspect every ply of every form coming out of the collator. This was the reason that the printing operation was kept separate from the collator. If the printer did not have to stop there would be no half-printed plies.

The present invention elminates this because of the special ink used in the printer-processor which will not dry on the rollers, and will maintain the proper film thickness. When the collator stops, the printer-processor may stop, and may be started again, and still continue printing the rest of the ply. This results in no part-printed images on plies and allows the paper being processed in the printer-processor to go directly into the collator.

In FIG. 2 after the paper leaves the flexographic printer the paper goes through a standard line hole punch unit 38, through a perforating unit 40, and finally through a pull roll unit 42. The paper is then fed directly to collator 14.

Figure 3:
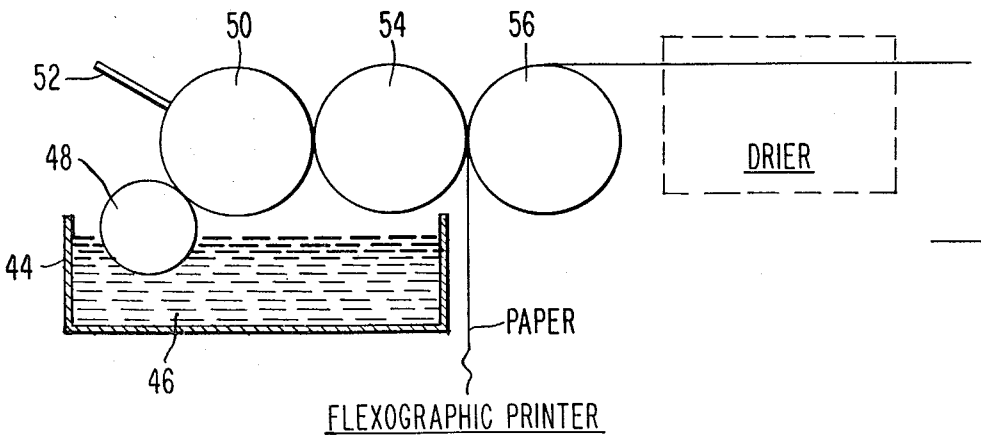
FIG. 3 is a diagrammatic view of a flexographic printer as used in the present invention.

FIG. 3 shows a flexographic printer similar to what is known in the art. Reservoir 44 contains the ink 46 which is used in the printing process. Ink 46 is a special absorptive-thixotropic ink. The ink will be described in detail subsequently. Ink 46 is lifted from reservoir 44 by ink roller 48 onto anilox roller 50. The anilox roller is known in the art and is a standard roller with indentations in the surface which hold the ink on the roller. A doctor blade 52 scrapes the ink off of the surface of the roller and leaves the remaining ink in the indentations on the anilox roller. A reverse angle doctor blade is preferred. However, either a trailing doctor blade type flexographic printer or a doctor roll type flexographic printer could be used. Ink 46 is transferred from anilox roller 50 to plate cylinder 54 which has printing plates on its surface for printing the individual plies. Paper from roll 32 makes contact with the plate cylinder and with an impression cylinder 56. The plate cylinder transfers the image to the paper and the paper wraps around the impression cylinder and extends to line hole punch 38 as shown in FIG. 2. It should be pointed out that a normal flexographic printer, not using the absorptive-thixotropic type ink as the present invention, would have required a drier to dry the ink and paper after it left the impression cylinder and before it left the flexographic printer. The use of the absorptive-thixotropic type ink has eliminated the need for the drier in the present invention.

The flexographic printer has been used with a variety of different inks, some of which are evaporative, drying type inks and some of which are other types of inks which do not dry by absorption into the paper. It has not been known in the past to use absorptive-thixotropic type inks in a flexographic printer. The realization that the absorptive-thixotropic type ink would allow the flexographic printer to be shut on and off in conjunction with the collator has made the present invention possible. An example of the absorptive-thixotropic type ink which was formulated for the printing and collating operation of the present invention is as follows: Several properties were needed for the ink. First, the ink had to be non-drying on printing equipment. High-boiling, non-volatiles were selected so that the printing press could be stopped and started without wash-up. The ink had to dry by absorption into the paper. The second feature of the ink was that it must be non-bleed type ink. Pigments and oils were selected that would not color the oil phase of the ink. This property was tested by putting a drop of ink on a sheet of very absorptive paper and then observing the lateral oil bleed for color. A very slight coloration could be tolerated but a strong coloration would cause the print image to have a poor definition. A third property of the inks was that they be made thixotropic. Thixotrophy is the property wherein a dispersion becomes very viscous until a slight sheer stirring is applied which causes the viscosity to become low. This property is common in water based paints. Thixotropic inks can be allowed to remain on the fountain parts for extended periods of time without pigment settling out. The film thickness will remain the same at operational speeds or when stopped. A fourth property of the ink is the viscosity. Trial and error showed that viscosities in the range of 1,500–3,500 centipoises were optimum. An example of the ink is as follows. Blown 300 oil (animal oil esters - blown) manufactured by Neatsfoot Oil Refineries Corporation, constitutes 71.8% by weight of the total composition weight. Sotex COS 2 (long chain fatty acid ester of alkyl amino linkage) manufactured by Morton Chemical Division of North Norwich Products constitutes 0.45% of the total weight of the composition. The Sotex COS - 2 is a pigment dispersing agent. The third element is black tone bk-0186 manufactured by Paul Uhlick Co. This is a black toner with a dye on the surface. The black toner constitutes 27.75% by weight of total composition weight of the ink. Next, all materials are added to an Attritor mill. Materials are milled for one hour at not over 100 degrees Farenheit. The specifications are as follows. The grind must be a 6+ on the Hegeman fineness of grind gauge. The viscosity, when the ink is made, must be 2,500–3,500 centipoises at 82 degrees Farenheit measured on a Brookfield model LVF No. 3 spindle at 12 RPM. After 24 hours the viscosity must read 2,000–3,000 centipoises at 82 degrees Farenheit measured on a Brookfield model LVF No. 3 spindle at 12 RPM.

A wide variety of inks may be formulated which would meet the needs of the invention for an absorptive-thixotropic type ink. The example above is one example of an ink that will work.

Another feature of the invention is the use of a unique assembly of small, man-handleable plate cylinders and a gear cluster to replace the standard 14 inch, 17 inch, 22 inch, and 24 inch circumference print cylinders that are commonly used on printing presses currently. These various circumferences of print cylinders will accommodate most or virtually all standard forms made today. For small standard forms, several forms may be accommodated with one revolution of the print cylinder. For example, four 6 inch forms could be printed with one revolution of a 24 inch circumference plate cylinder. The use of the unique gear cluster and smaller print plates in a flexographic printer has allowed the invention to be much smaller and still have the flexibility to produce the standard forms. The unique gear cluster allows replacement plate cylinders to be placed in the flexographic printer depending on the size of form needed. In other words, for one size form a plate cylinder may be put into the flexographic printer. If another size is desired the old plate cylinder will be removed and another plate cylinder will be reinserted. The gear assembly in the flexographic printer has the appropriate gears to allow a wide variety of plate cylinders to be inserted in the flexographic printer thus allowing a wide variety of forms to be printed.

Figures 4, 5:
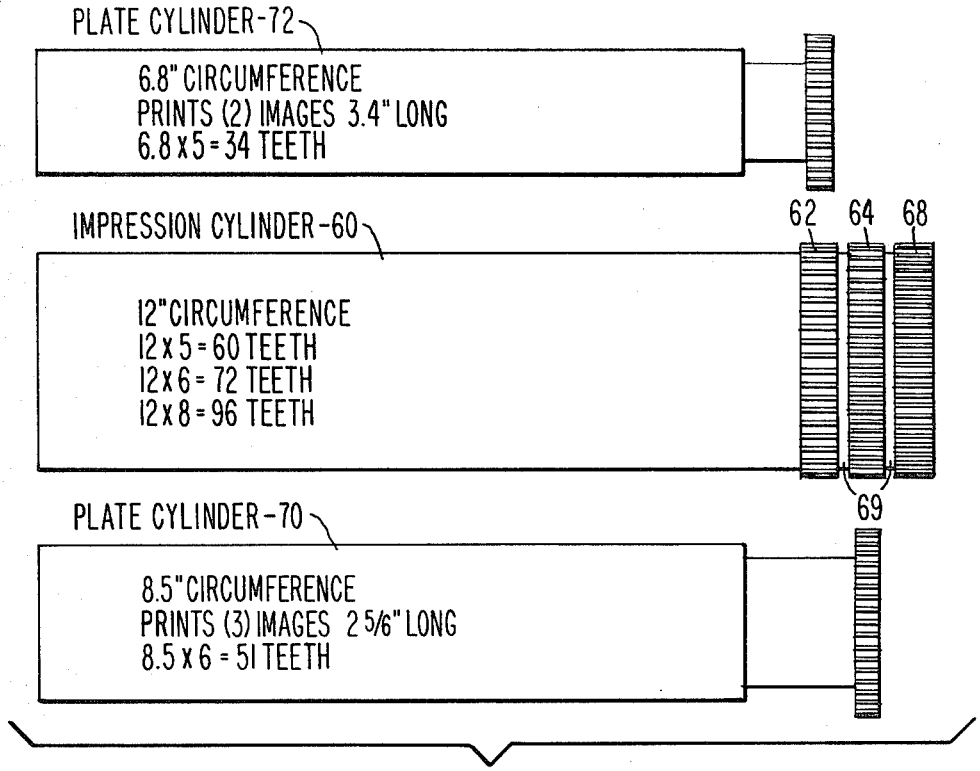
FIG. 4 is a diagrammatic view of the impression cylinder, plate cylinders and gear clusters used in the printer-processor of the present invention.
FIG. 5 is a list in tabular form of various plate cylinder sizes and the appropriate matching gear combinations to produce standard size business forms.

FIG. 4 shows diagrammatically the impression cylinder and plate cylinders of a typical flexographic printer. The impression cylinder 60 is a 12 inch circumference having a gear cluster at the end with three gears 62, 64, 68 having pitches of 1/5, 1/6, and 1/8, and having 60 teeth, 72 teeth, and 96 teeth respectively. The gears are all separated by spacers 69 to prevent plate cylinder gears from running into adjoining gears. The impression cylinder normally is left in the flexographic printer and keeps the same circumference. In unusual circumstances it could be changed. Shown on either side of impression cylinder 60 are plate cylinders 70 and 72. In reality, only one plate cylinder would normally be used in the flexographic printer, however, for illustration purposes of showing different size interchangeable plate cylinders and different size gearing on the plate cylinders, two are shown in the figure. Plate cylinder 70 is 8.5 inches in circumference and will print three images 2 5/6 inches long. The pitch on the gear on the plate cylinder is 1/6 and will mate with gear 64 of the impression cylinder gear cluster. This plate cylinder could be removed and plate cylinder 72 made to replace it. Plate cylinder 72 is 6.8 inches in circumference and will print two images 3.4 inches long. The gear on plate cylinder 72 has a pitch of 1/5 and mates with gear 62 of the gear cluster of impression cylinder 60. By designing thee appropriate circumference of the cylinder with the appropriate pitch on the gear, a wide variety of plate cylinders able to produce a wide variety of sizes of forms may be used with the three gears on the impression cylinder 60.

Table 1 shows the variety of plate cylinder circumferences, what document size they produce, and the pitch of the gears that may be used on the plate cylinder. For example, a plate cylinder having a circumference of 6 inches will produce a document size of 6 inches, and pitches of 1/5, 1/6 or $\frac{1}{8}$ may be used for the gear on the plate cylinder. In the same way, a plate cylinder circumference of 8.5 inches will produce documents of $8\frac{1}{2}$ inches, $4\frac{1}{4}$ inches, or 2 5/6. The gears used for an 8.5 plate cylinder could have a pitch of either 1/6 or $\frac{1}{8}$. With a limited number of plate cylinders (11) and 3 gear pitches, virtually all standard size forms may be produced. Each of these cylinders is small enough to be replaced on a flexographic printer easily by one man. This is in contrast to a standard printing press which normally contains cylinders of 14, 17, 22 and 24 inch circumferences, which takes several persons and/or hoists to replace. The standard printing press is fifty feet long or longer and the printer-processor is a very small unit taking up only a few feet of the floor space.

The invention has several unique features. The first feature is the use of absorptive-thixotropic ink in the flexographic printer which enables the printer to be shut on and off as the collator is shut on and off, thus, allowing paper to be fed straight from the paper roll in the printer-processor unit directly to the collator. This eliminates the need to do all printing continuously and rewind the printed forms for use later in the collator. This allows savings in time and factory floor space and in expense of equipment. Another unique feature which assits in allowing the printer-processor unit to dispense with the need for rewinding paper is the use of the unique gear cluster on the flexographic printer. The unique gear cluster allows the flexographic printer to be adapted for virtually all standard size forms. This allows a flexographic printer to be used in place of the very large printing presses currently used. Because the flexographic printer is small, and takes up only a very small amount of floor space, it can conveniently be located right next to the collator or attached right to the collator. Because of the size of conventional printers of fifty feet length or more this was very inconvenient previously.

What is claimed is:

1. An apparatus for preparing individual plies from a paper roll for feeding into a manifold forms collator comprising:

a printer-processor utilizing the paper from said paper roll, said printer-processor using an absorptive ink which dries substantially by absorption, said ink staying in liquid form during stopping and starting periods of said printer-processor, said ink also being thixotropic so as to remain in place at proper film thickness on the printing surfaces of said printer-processor at operational speeds or when stopped, said absorptive thixotropic ink enabling the printer-processor to deliver to the collator webs of paper having an uninterrupted sequence of images of uniform quality, said paper having one continuous path between said printer-processor and said manifold forms collator.

2. The apparatus of claim 1 in which said printer has an inking roller with indented cells for picking up and holding said thixoropic absorptive ink.

3. The apparatus of claim 2 having a means for doctoring off ink from the surface of said ink roller and leaving ink in said indented cells in said ink roller, said absorptive ink having a degree of thixotrophy so as to stay in said indented cells.

4. The apparatus of claim 3 in which said means for doctoring is a doctor blade.

5. The apparatus of claim 3 in which said means for doctoring is a doctor roll.

6. The apparatus of claim 3 in which a relief plate printing cylinder picks up the thixotropic absorptive ink from said indented cells and transfers said ink to said paper, the thixotropic absorptive ink remaining in place in the proper film thickness on the printing surfaces of said plate cylinder regardless of operating rotational speed and when the apparatus is stopped, the film of thixotropic absorbent ink being transferred in a uniform manner to the paper regardless of rotational speed or prior rotational interruptions.

7. The apparatus of claim 6 in which said paper roll is stored on a paper unwind and fed to said printer-processor.

8. The apparatus of claim 6 in which a zigzag folded pack is stored for feeding into said printer-processor.

9. The apparatus of claims 1 or 7 including a line hole punch for punching holes in at least one of the sides of said individual plies to assist said collator in registration and movement of said plies.

10. The apparatus of claim 9 including a perforation unit for perforating said paper roll to make individual plies for use in said manifold forms collator.

11. The apparatus of claim 1 in which said printer-processor has an impression cylinder and a plate cylinder, said impression cylinder having multiple gears affixed thereto, said plate cylinder having a single gear affixed thereto for mating with one of said multiple gears of said impression cylinder, said plate cylinder being interchangeable with other plate cylinders of different circumference, the circumference of said plate cylinder, the pitch of said gear on said plate cylinder and the pitch of said gear on said impression cylinder mating with said gear on said plate cylinder, all being selectable to print different standard size business forms, with the plate cylinders of minimum circumference, the determinant for minimum circumference being stiffness of said paper web.

12. The apparatus of claim 11 in which all forms can be printed with cylinders of a circumference of 11″ or less.

13. The apparatus of claim 11 in which said impression cylinder has 3 gears with gear pitches selected from a group of gear pitches consisting of 1/10, 1/5, 1/6, $\frac{1}{3}$, 1/16, $\frac{1}{8}$ or $\frac{1}{4}$.

14. The apparatus of claim 13 in which said plate cylinder has a gear pitch selected for a group of gear pitches consisting of 1/10, 1/5, 1/6, $\frac{1}{3}$, 1/16, $\frac{1}{8}$ or $\frac{1}{4}$.

15. The apparatus of claim 14 in which said printer is a flexographic printer.

* * * * *